United States Patent [19]

Bollands et al.

[11] Patent Number: 4,715,455

[45] Date of Patent: Dec. 29, 1987

[54] DRILL SHOE

[75] Inventors: Martin A. Bollands; William C. Pike, both of Surrey; Prem S. Thukral; Timothy P. Woolmington, both of Middlesex, all of England

[73] Assignee: The British Petroleum Company p.l.c., London, England

[21] Appl. No.: 918,320

[22] Filed: Oct. 14, 1986

[30] Foreign Application Priority Data

Oct. 18, 1985 [GB] United Kingdom ..... 8525757

[51] Int. Cl.[4] ..... E21B 10/02

[52] U.S. Cl. ..... 175/402

[58] Field of Search ..... 175/20, 402, 403, 404, 175/19, 244, 21, 22, 405; 138/145, 146, DIG. 7, DIG. 3

[56] References Cited

U.S. PATENT DOCUMENTS

| | | | |
|---|---|---|---|
| 1,058,567 | 4/1913 | Edgar et al. | 175/402 |
| 1,062,647 | 5/1913 | Guiberson et al. | 175/402 |
| 1,078,530 | 11/1913 | Baker | 175/402 |
| 2,646,822 | 7/1953 | Ferguson | 138/145 X |
| 3,833,075 | 9/1974 | Bachman et al. | 175/20 |
| 4,146,060 | 3/1979 | Garrett | 175/325 X |
| 4,603,748 | 8/1986 | Rossfelder et al. | 175/19 |

*Primary Examiner*—Stephen J. Novosad

*Attorney, Agent, or Firm*—Morgan & Finnegan

[57] ABSTRACT

A drill shoe adapted to fit onto a drill pipe of external diameter $d_e$ and internal diameter $d_i$ comprises an externally stepped cutting surface comprising a plurality of steps, the diameters of the steps increasing as they progress away from the tip of the shoe. The maximum external diameter $D_e$ of the shoe is greater than the external diameter $d_e$ of the drill pipe. The shoe also comprises an internal, substantially cylindrical, inner surface of diameter $D_i$, $D_i$ being less than the internal diameter $d_i$ of the drill pipe.

The shoe is suitable for use in a vibratory drill string for obtaining cores from unconsolidated geological formations, such as soil, sand and gravel or similar materials.

5 Claims, 2 Drawing Figures

DRILL SHOE

Figure 1:
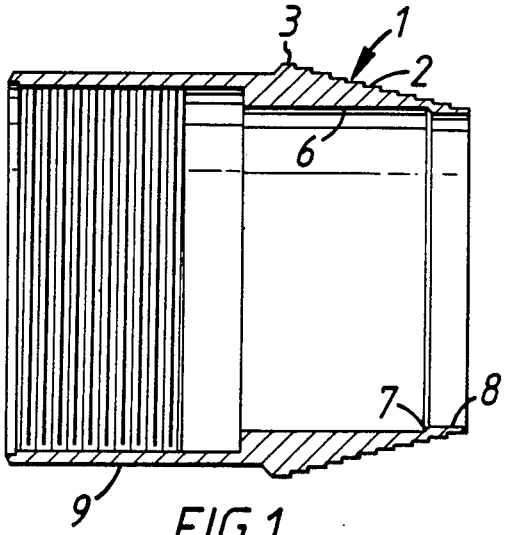

This invention relates to a drill shoe suitable for use in a vibratory drill string for obtaining cores from unconsolidated geological formations, such as soil, sand and gravel or similar materials.

Vibratory drilling is a known technique in which a formation is penetrated by vibrating a drill string without rotating it. This allows cores to be obtained with minimum disturbance from their in-situ condition. The drill string is fitted at its lower end with a bit, otherwise known as a shoe, to provide a cutting edge. The shoe is generally in the form of a hollow cone with a smoothly tapering exterior wall. The frequency of vibration is often in the sonic range, in which case the technique is known as sonic drilling.

While penetration in a suitable formation can be very fast, conditions are often encountered where, either in the zone to be cored or in the overlying formations, penetration is extremely slow or indeed the drill may refuse. Reasons for refusal include:

(1) congestion of the tube with the cored material which, due to friction on the inside of the tube, damps the vibrations;

(2) friction between the outside of the tube and the formation which again attenuates the vibrations;

(3) inability of the shoe to break down the formation around its cutting edge so allowing it to be displaced from the contact zone and allowing the tube movement to progress.

We have now devised a drill shoe which is more effective in overcoming these problems than previously employed shoes.

Thus according to the present invention there is provided a drill shoe adapted to fit onto a drill pipe of external diameter $d_e$ and internal diameter $d_i$, the shoe comprising an externally stepped cutting surface comprising a plurality of steps, the diameters of the steps increasing as they progress away from the tip of the shoe, the maximum external diameter $D_e$ of the shoe being greater than the external diameter $d_e$ of the drill pipe, the shoe also comprising an internal, substantially cylindrical, inner surface of diameter $D_i$, $D_i$ being less than the internal diameter $d_i$ of the drill pipe.

The final step, which by definition projects beyond the diameter of the drill pipe, will provide rim contact with the side of the borehole and leave some clearance for the drill pipe. The length of this section, the land, should be kept to the minimum consistent with wear life to reduce vibration damping losses.

The fact that $D_i$ is less than $d_i$ permits clearance of the core in the drill pipe and again reduces vibration damping. In order to improve clearance still more, the internal diameter of the shoe at the tip may be further reduced, preferably by means of one or more steps.

The stepped external surface provides a series of cutters, each of which cuts a progressively larger diameter of the formation.

The overall angle of taper of the stepped surface and the axial and radial proportion of each step are variable, allowing for a wide range of designs to cope with differing circumstances.

Flutes may be provided in the land and cutting surfaces to facilitate the penetration of the shoe.

In use, the shoe will be fitted onto a drill pipe. In order to reduce the damping effect of friction on the frequency of vibration of the pipe, the pipe may be coated, externally or internally or both, with a friction reducing material. Nylon R is a suitable material.

Such coatings may be applied either in the immediate vicinity of the shoe or may extend axially to whatever extent proves beneficial.

A suitable frequency of vibration is in the range 100 to 200 Hz.

An additional advantage of the features described above is the improvement they allow in ease of removal of drill string and of extraction of the core material.

A shoe according to the present invention is suitable for use in glacial tills and in the core sampling of tar sands and alluvial areas suspected of containing gold, diamonds or other minerals.

Figure 2:
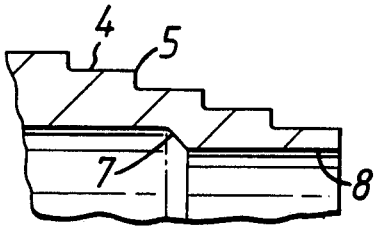

The invention is illustrated with reference to FIGS. 1 and 2 of the accompanying drawings wherein FIG. 1 is a section of a drill shoe and FIG. 2 is a detail of FIG. 1.

With reference to the drawings, the drill shoe 1 comprises an external stepped cutting surface 2 and a land 3. The external diameter $D_e$ of the land is greater than the external diameter $d_e$ of the drill pipe to which the shoe is to be fitted.

The steps 4 are formed with cutting edges 5 and the horizontal and vertical planes merge into a curved connecting surface.

The shoe 1 also comprises a substantially cylindrical inner surface 6, the diameter of which $D_i$ is less than the internal diameter $d_i$ of the drill pipe to which the shoe is to be fitted. The inner surface 6 has a single step 7 leading to a section of reduced internal diameter 8 at the tip of the shoe.

A standard drill pipe, not shown, is connectable to the heel 9 of the shoe.

EXAMPLES

Example 1

A standard shoe was fitted on two 1.5 m sections of standard HQ drill rod and tested in a sonic drilling rig operated at a frequency of 200 Hz.

Example 2

Example 1 was repeated using the experimental shoe described above.

Example 3

Example 2 was repeated with the difference that the inner surface of the lower drill rod was coated with Nylon R.

The following results were obtained.

From 0 to 1.5 m drilling was through top clay and from 1.5 m onwards through Thames gravel.

TABLE

| | Ex 1 | Ex 2 | Ex 3 |
|---|---|---|---|
| | Time (minutes) | | |
| Penetration Depth (meter) | Standard Shoe + 2 × 1.5 m HQ drill rod | Experimental Shoe + 2 × 1.5 m HQ drill rod | Experimental Shoe + 1.5 m low friction HQ rod + 1.5 m standard HQ rod |
| 0.1 | 0.03 | 0.22 | |
| 0.2 | 0.18 | 0.48 | Too |
| 0.3 | 0.33 | 0.89 | fast |
| 0.4 | 0.42 | 1.16 | to |
| 0.5 | 2.95 | | record |
| 0.6 | Penetration | 1.30 | |
| 0.7 | ceased at | | |
| 0.8 | 0.55 m/ | 1.41 | 0.29 |
| 0.9 | 6.15 mins | | 0.81 |

TABLE-continued

| Penetration Depth (meter) | Ex 1 Standard Shoe + 2 × 1.5 m HQ drill rod | Ex 2 Experimental Shoe + 2 × 1.5 m HQ drill rod | Ex 3 Experimental Shoe + 1.5 m low friction HQ rod + 1.5 m standard HQ rod |
|---|---|---|---|
| | | Time (minutes) | |
| 1.0 | | 1.58 | 1.78 |
| 1.1 | | 2.47 | 3.21 |
| 1.2 | | Test terminated at 1.15 m/ 3.0 mins | 5.42 |
| 1.3 | | | 6.63 |
| 1.4 | | | 7.57 |
| 1.5 | | | 8.45 |
| 1.6 | | | 9.23 |
| 1.7 | | | 9.99 |
| 1.8 | | | 10.37 |
| 1.9 | | | 10.65 |
| 2.0 | | | 10.88 |
| 2.1 | | | 11.07 |
| 2.2 | | | 11.26 |
| 2.3 | | | 11.45 |
| 2.4 | | | 11.63 |
| 2.5 | | | 11.79 |
| 2.6 | | | 11.92 |
| 2.7 | | | |
| 2.8 | | | 12.25 |
| 2.9 | | | Test terminated |

TABLE-continued

| Penetration Depth (meter) | Ex 1 Standard Shoe + 2 × 1.5 m HQ drill rod | Ex 2 Experimental Shoe + 2 × 1.5 m HQ drill rod | Ex 3 Experimental Shoe + 1.5 m low friction HQ rod + 1.5 m standard HQ rod |
|---|---|---|---|
| | | Time (minutes) | |
| 3.0 | | | at 2.8 m |

We claim:

1. A drill shoe adapted to fit onto a drill pipe of external diameter $d_e$ and internal diameter $d_i$, the shoe comprising an externally stepped cutting surface comprising a plurality of steps, the diameters of the steps increasing as they progress away from the tip of the shoe, the maximum external $D_e$ diameter of the shoe being greater than the external diameter $d_e$ of the drill pipe, the shoe also comprising an internal, substantially cylindrical, inner surface of diameter $D_i$, $D_i$ being less than the internal diameter $d_i$ of the drill pipe and the internal diameter of the shoe is further reduced at the tip.

2. A drill shoe according to claim 1 wherein the internal diameter of the shoe is reduced at the tip by means of one or more steps.

3. A drill shoe according to claim 1 wherein flutes are provided in the land and cutting surfaces.

4. A drill string comprising a shoe according to claim 1 fitted to a drill pipe, the drill pipe being coated externally or internally or both with a friction reducing material.

5. A drill string according to claim 4 wherein the friction reducing material is Nylon R.

* * * * *